US008783219B2

(12) United States Patent
Gunnel et al.

(10) Patent No.: US 8,783,219 B2
(45) Date of Patent: Jul. 22, 2014

(54) SWITCHABLE CAM FOLLOWER

(75) Inventors: Ronny Gunnel, Hirschaid (DE); Norbert Nitz, Erlangen (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 0 days.

(21) Appl. No.: 13/883,873

(22) PCT Filed: Aug. 2, 2011

(86) PCT No.: PCT/EP2011/063296
§ 371 (c)(1),
(2), (4) Date: May 7, 2013

(87) PCT Pub. No.: WO2012/069215
PCT Pub. Date: May 31, 2012

(65) Prior Publication Data

US 2013/0220250 A1 Aug. 29, 2013

(30) Foreign Application Priority Data

Nov. 25, 2010 (DE) ..... 10 2010 052 551

(51) Int. Cl.
*F01L 1/18* (2006.01)

(52) U.S. Cl.
USPC ..... 123/90.39; 74/559; 74/569

(58) Field of Classification Search
USPC ..... 123/90.39, 90.44; 74/559, 567, 569
See application file for complete search history.

(56) References Cited

U.S. PATENT DOCUMENTS 5,544,626 A 8/1996 Diggs et al.
6,532,920 B1 3/2003 Sweetnam et al.

(Continued)

FOREIGN PATENT DOCUMENTS

DE 10310220 9/2004
DE 102004007766 9/2004

(Continued)

*Primary Examiner* — Ching Chang
(74) *Attorney, Agent, or Firm* — Volpe and Koenig, P.C.

(57) ABSTRACT

A switchable cam follower (1) of a valve train of an internal combustion engine is proposed, having an inner lever and an outer lever (2, 3), wherein the levers (2, 3) can be connected to one another via coupling means (12) and run on a common pin (15) such that they can be moved pivotably relative to one another, which pin (15) is projected around by at least one group of turns (16) of a swivel pin spring (17) as cam restoring spring, wherein a first limb (19) which protrudes from an end side (18) of the group of turns (16) acts on a first clamping point (20) of the outer lever (3) and a second limb (22) which protrudes from another end side (21) of the group of turns (16) acts on a second clamping point (23) of the inner lever (2), in the rotational direction in such a way that the levers (2, 3) are present such that they are stressed towards one another, wherein the pin (15) runs in a "floating" manner with respect to the holes (13, 14), wherein the group of turns (16) comprises a bush (24) with play, wherein axial fixing of the pin (15) is produced via the offset contact of the group of turns (16) on the bush (24), which offset contact is brought about by the system stressing, and therefore the offset contact of said bush (24) on the pin (13), and wherein, in order to reduce a resulting contact force (FR) in the region of the contact of the group of turns (16) on the bush (24), the clamping points (20, 23) of the two limbs (19, 22) of the group of turns (16) are positioned in such a way that an angle ($\alpha$) which is enclosed by intersecting force vectors at the clamping points (20, 23) [direction of action of the two contact forces (F1, F2)] lies in the range ($90° < \alpha < 180°$).

7 Claims, 2 Drawing Sheets

(56) References Cited

U.S. PATENT DOCUMENTS

| | | | |
|---|---|---|---|
| 2003/0209217 | A1 | 11/2003 | Hendriksma et al. |
| 2004/0237919 | A1 | 12/2004 | Haas et al. |
| 2006/0157011 | A1 | 7/2006 | Proschko et al. |
| 2008/0295789 | A1 | 12/2008 | Manther et al. |
| 2010/0236507 | A1 | 9/2010 | Kang et al. |

FOREIGN PATENT DOCUMENTS

| | | |
|---|---|---|
| DE | 102005035053 | 2/2007 |
| DE | 102006046574 | 4/2008 |

SWITCHABLE CAM FOLLOWER

FIELD OF THE INVENTION

The invention concerns a switchable finger lever of a valve train of an internal combustion engine, said finger lever comprising an inner lever and an outer lever, and further comprising on an underside on one end, a support for a gas exchange valve, and also comprising on a further end, a complementary surface for a support element, one of said two levers comprising on an upper side, a contacting surface for a high lift cam, a further one of said two levers comprising a contacting surface for a low lift or zero lift cam, said two levers being able to be connected to each other through a coupling means and extending via bores on a common axle for pivoting relative to each other, said axle being surrounded by at least one coil assembly of a torsion leg spring as cam re-setting spring, a first leg protruding from one front end of said coil assembly acting on a first chucking point of the outer lever in twisting direction and a second leg protruding from a further front end of said coil assembly acting on a second chucking point of the inner lever in twisting direction so that said levers are braced against each other, said axle extending "floatingly" relative to said bores, said coil assembly surrounding with lash at least one bushing, and an axial fixing of said axle being realized through an axis-offset segmental support of the coil assembly on the bushing in a braced state of the system and thus also through an axis-offset support of the bushing on the axle through a segmental part of an inner peripheral wall of the bushing.

BACKGROUND

A finger lever of the pre-cited type is known from FIG. 1 of DE 10 2006 046 574 A1. This figure shows a "floatingly" mounted axle protruding with a journal on both sides from the outer lever, each journal being surrounded by a bushing. This bushing, in its turn, is surrounded by a coil assembly of a torsion leg spring. In the braced state of the system, the coil assembly presses the bushing segmentally onto the axle which leads to an axial fixing of the axle. According to one embodiment, the bushing projects with an extension extending radially inwards from the inner peripheral wall of the bushing into a complementary circumferential groove of the axle.

For guaranteeing an uncoupling mode at high speeds of rotation of the internal combustion engine (reliable cam return of the uncoupled lever), and for coping with large moving masses during operation, high righting moments of the torsion leg springs are required. In the design shown in FIG. 1 of DE 10 2006 046 574 A1, it can be seen that the force vectors at the chucking points of the two legs of the torsion leg spring on the inner and the outer lever extend almost parallel to each other, or at least include an angle of <90°. This leads to a relatively high resulting overall force in the section of the axis-offset support of the coil assembly. In other words, the magnitude of the resulting overall force is clearly larger than the magnitude of the individual contact forces at the chucking points. In the uncoupling mode, the coil assembly pressed onto the respective bushing executes a movement relative to the bushing. This results in an undesired high wear in the segmental contact region of the coil assembly on the bushing.

SUMMARY

It is therefore an object of the invention to clearly reduce the wear in the region of the axis-offset support of the coil assembly on the bushing while retaining a high righting moment of the torsion leg spring.

The invention achieves the above object by the fact that the chucking points of the two legs of the coil assembly are positioned such that an angle $\alpha$ included by intersecting force vectors at the chucking points [effective direction of the two contact forces] is situated in the range of $90° < \alpha < 180°$.

In this way, a switchable finger lever is created in which the aforesaid wear problems no longer occur or are clearly minimized. The magnitude of the resulting contact force is now smaller than the magnitude of each of the individual contact forces. However, for obtaining a reliable fixing of the axle, the magnitude of the resulting contact force is advantageously chosen such that it is never equal to zero at any moment of time during operation.

Through an adequate choice of the chucking points of the legs of the torsion leg spring, an effective direction of the two contact forces is now created that leads to a drastically reduced resulting contact force in the aforesaid segmental support region.

According to an advantageous specification of the invention, it is proposed, to put it simply, that an extension of the inner lever comprising the second chucking point be bent upwards in contrast to the initially described prior art (while retaining or only slightly changing the first chucking point) so that an angle formed between the two force vectors at the chucking points during the support of the second leg of the torsion leg spring is clearly larger than 90° but visibly smaller than 180°. If need be, only the first chucking point on the outer lever is appropriately modified, or both chucking points are re-configured.

The scope of the invention further includes a solution in which the at least one coil assembly extends directly on the axle. In this way, the use of the bushing is rendered superfluous, and this leads to a saving of costs.

According to an advantageous development of the invention, each of the coil assemblies of the torsion leg spring comprises only two load-bearing coils. Because, during the twisting step, the coils do not "brace" identically but the coil next to the leg is more strongly twisted, it is clear that if there were a larger number of coils, relative movements of the coils between each other on the bushing would result, and this is not desirable.

The scope of the invention also includes a solution in which only one torsion leg spring arranged on one end of the finger lever is used and surrounds the axle through its coil assembly, for example, between arms of the inner lever. Alternatively, it is also possible for only one journal to project from one of the sides of the finger lever and a respective coil assembly to be seated on this journal, or a coil assembly to be applied only to one of two projecting journals.

According to a further specification of the invention, on the valve shaft support on the one end, the finger lever has a receding configuration. In this case, the inner lever advantageously comprises only one straight end bar on which arms of the outer lever bent angularly towards each other run out. In this way, adequate design space is created for the axle journals with the coil assemblies. Preferably, the axle journals do not protrude beyond the outer walls of the outer lever outside of the receding section on the one end.

A particularly reliable fixing of the axle is realized if, as proposed, a radial collar projects inwards from the corresponding bushing and engages positively into a complementary groove of the axle.

Preferably, but not exclusively, the outer lever of the finger lever, as seen in a top view, has a box-like geometry with a recess in which the inner lever is received. It is, however, also imaginable and intended to use only two elongate bars situated right next to each other.

For decreasing wear at the contact points as well as on the segmental support surfaces and on the cam contacting surfaces, it is possible to use applied layers and/or hear treatment measures.

In addition, the scope of the present invention also includes finger levers that are intended, for instance, for being loaded by at least one outlet valve while their outer levers can be loaded by "normal" high lift cams, and the inner lever, in contrast can be contacted by an "offset" additional, low lift cam through which an internal exhaust air return can be realized.

BRIEF DESCRIPTION OF THE DRAWINGS

The invention will now be described with reference to the appended drawing.

DETAILED DESCRIPTION OF THE PREFERRED EMBODIMENTS

Figure 1:
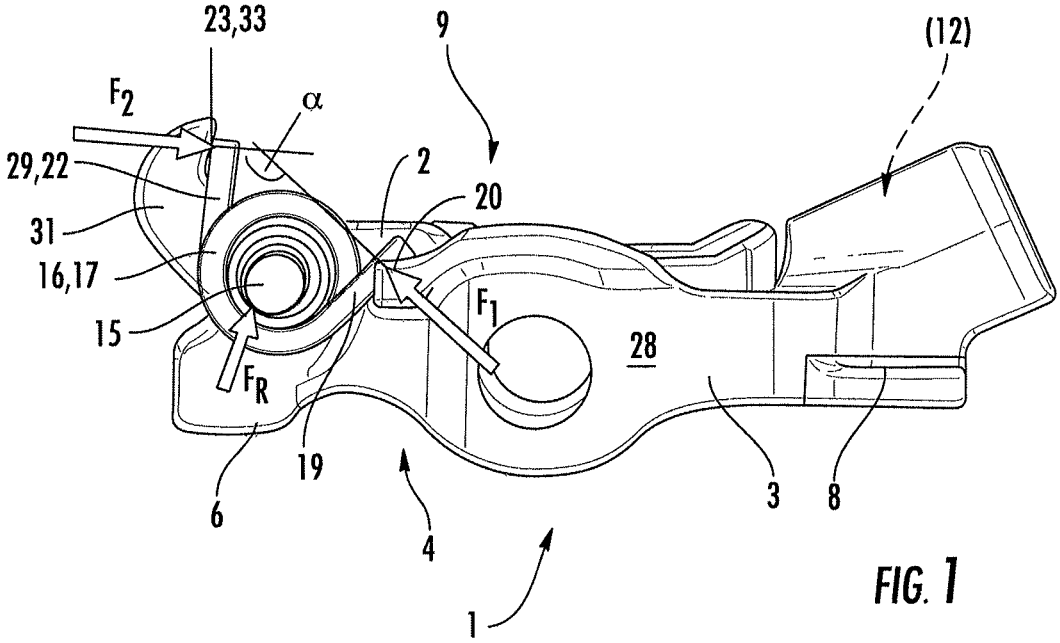
FIG. 1 shows a side view of the finger lever.
Figure 2:
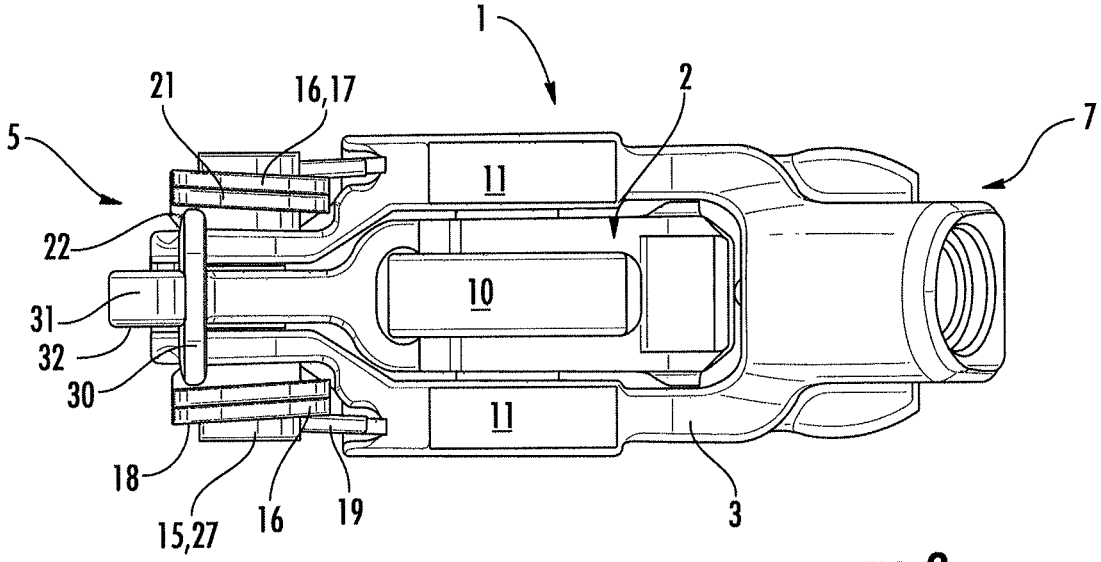
FIG. 2 shows a top view of the finger lever of FIG. 1.

What is shown is a switchable finger lever 1 of a valve train of an internal combustion engine, said finger lever 1 comprising an elongate outer lever 3 between whose arms an inner lever 2 extends.

On one end 5 on an underside 4, the finger lever 1 comprises a support 6 for a gas exchange valve. On a further end 7, the outer lever 3 comprises on the underside 4, a complementary surface 8 for mounting on a head of a support element.

The finger lever 1 comprises on an upper side 9 of its inner lever 2, a contacting surface 10, configured in the present case as a roller, for a high lift cam. Contacting surfaces 11 for low lift cams, in contrast, are configured as sliding surfaces on the outer lever 3. In the region of the further end 7 is applied a longitudinally displaceable coupling means 12 not needing a specific description here.

It can be seen further that the levers 2, 3 on the one end 5 extend via their bores 13, 14 on a common axle 15 towards each other and are mounted for pivoting relative to each other. The axle 15 is "floatingly" retained relative to the bores 13, 14, i.e. it is not fixed in axial direction through a calking, welding, snap ring retention etc.

The levers 2, 3 are braced after the manner of a clasp knife against each other through a lost motion spring configured as a torsion leg spring 17 or a hairpin spring. As illustrated, the torsion leg spring 17 comprises two sections that extend as respective coil assemblies 16 on journals 27 of the axle 15 protruding on both sides from outer sides of the outer lever 3.

A first leg 19 projecting longitudinally from an outer front side 18 of each coil assembly 16 under the axle 15 acts on a first chucking point 20 of the outer lever 3 in front of the respective contacting surfaces 11. A second leg 22 projecting from another, inner front side 21 of each coil assembly 16 extends upwards from under the axle 15 with a short arm 29. Each short arm 29 merges into a bow-shaped clip 30 that acts on a finger-like extension 31 that projects upwards from the inner lever 2 on the one end 5 and comprises the second chucking point 23. As can be seen, the bow-shaped clips 30 engage over end pieces of the inner lever 2 and are united into a common transverse member.

Figure 3:
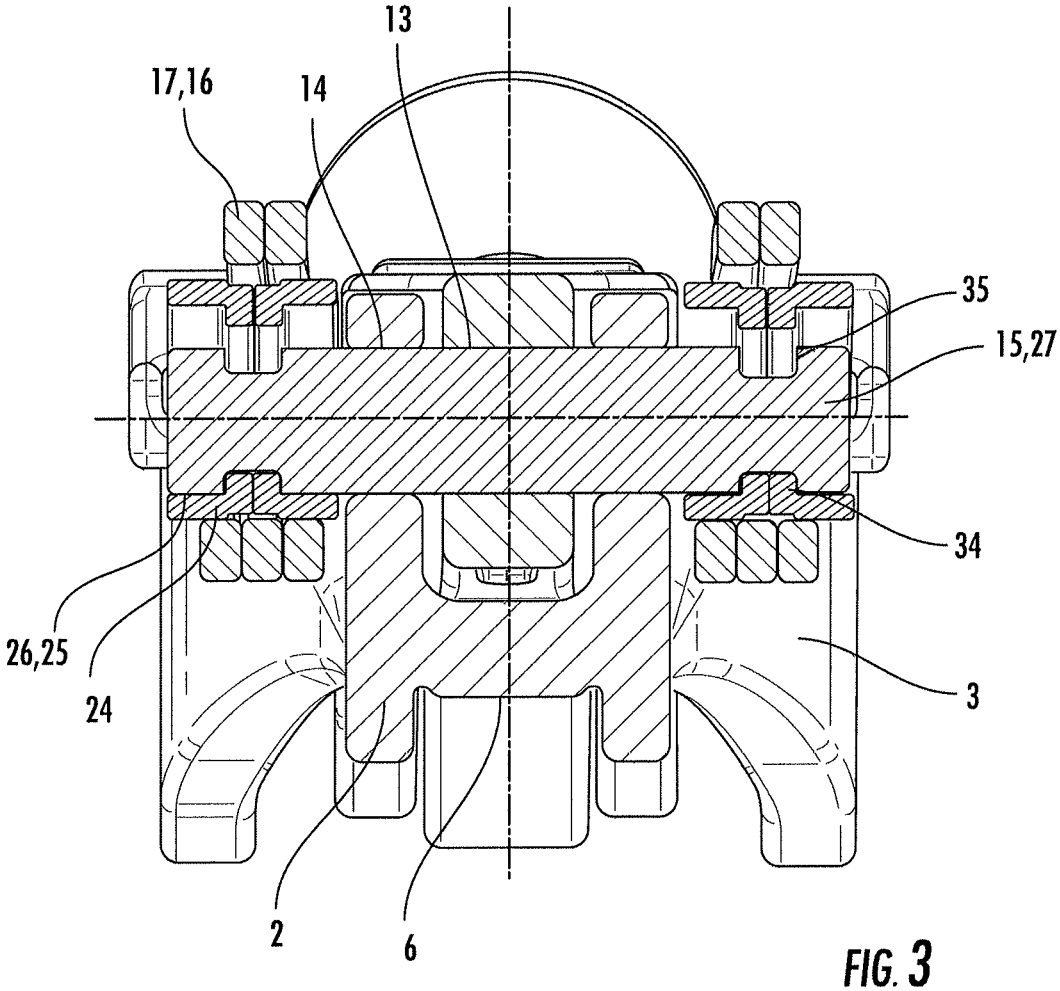
FIG. 3 shows a cross-section through the finger lever in the region of the axle.

An axial fixing of the axle 15 is realized through the axis-offset, segmental support of the respective coil assembly 16 on the corresponding bushing 24 caused by the braced state of the system and thus also through the axis-offset support of the bushing 24 through a segment-like part 25 of the inner peripheral wall 26 of the bushing 24 on the axle 15, a positive engagement being formed through the radial collar 34 disclosed in FIG. 3. As can be seen further, each coil assembly 16 comprises only two coils that bear loads on the underside during the braced state of the system.

For reducing a resulting contact force FR, in the region of the axis-offset support of the coil assembly 16 on the bushing 24, the chucking points 20, 23 of the two legs 19, 22 of the coil assembly 16 are positioned such that an angle $\alpha$ included by intersecting force vectors at the chucking points 20, 23 (effective direction of the two contact forces $F_1$, $F_2$) is situated in the range of $90° < \alpha < 180°$ (s. FIG. 1). However, an angle $\alpha$ of visibly $<180°$ is chosen in order not to fully neutralize the system bracing. Compared to the initially cited prior art DE 10 2006 046 574 A1, FIG. 1, this is realized through the aforesaid "higher positioning" of the finger-like extension 31 comprising the second chucking point 23 on its inner side 33 for the second leg 22 of the torsion leg spring 17.

Alternatively, it would be possible to retain the "low" second chucking point of DE 10 2006 046 574 A1, FIG. 1, in which case, the first chucking point 20 for the first leg 19 would be adequately "higher positioned".

LIST OF REFERENCE NUMERALS AND SYMBOLS

1 Finger lever
2 Inner lever
3 Outer lever
4 Underside
5 One end
6 Support
7 Another end
8 Complementary surface
9 Upper side
10 Contacting surface high lift cam
11 Contacting surface low lift cam
12 Coupling means
13 Bore
14 Bore
15 Axle
16 Coil assembly
17 Torsion leg spring
18 Outer front side
19 First leg
20 First chucking point
21 Another front side
22 Second leg
23 Second chucking end
24 Bushing
25 Segmental part bushing
26 Inner peripheral wall bushing
27 Journal
28 Outer side outer lever
29 Short arm
30 Transverse clip
31 Finger-like extension
32 Outer side inner lever
33 Inner side
34 Radial collar
35 Annular groove
$F_1$ Contacting force first chucking point $F_2$ Contacting force second chucking point $F_R$ Resulting contacting force $\alpha$ Angle between force vectors

The invention claimed is:

1. A switchable finger lever of a valve train of an internal combustion engine, said switchable finger lever comprising an inner lever and an outer lever, and further comprising on an underside on one end, a support for a gas exchange valve, and on a further end, a complementary surface for a support element, one of said two levers comprising on an upper side, a contacting surface for a high lift cam, and a further one of said two levers comprising a contacting surface for a low lift or zero lift cam, said two levers being connectable to each other through a coupling element and a common axle extending through bores therein for pivoting relative to each other, said common axle being surrounded by at least one coil assembly of a torsion leg spring as a cam re-setting spring, a first leg protruding from one front side of said coil assembly acting on a first chucking point of the outer lever in a twisting direction and a second leg protruding from a further front end of said coil assembly acting on a second chucking point of the inner lever in the twisting direction so that said levers are braced against each other, said common axle extending "floatingly" relative to said bores, said coil assembly surrounding with lash at least one bushing, and an axial fixing of said common axle being realized through an axis-offset segmental support of the coil assembly on the bushing in a braced state of the system and thus also through an axis-offset support of the bushing on the axle through a segmental part of an inner peripheral wall of said bushing, wherein, for reducing a resulting contacting force ($F_R$) in a region of the axis-offset support of the coil assembly on the bushing, the chucking points of the two legs of the coil assembly are positioned such that an angle ($\alpha$) included by intersecting force vectors at the chucking points defined by an effective direction of two contact forces ($F_1$, $F_2$) is in a range of $90° < \alpha < 180°$.

2. The switchable finger lever according to claim 1, wherein the common axle protrudes on both sides via a journal beyond outer sides of the outer lever, the coil assembly with the bushing being seated on each journal, the first leg of the torsion leg spring from the outer front side of each of the coil assemblies under the common axle in a lever longitudinal direction at an inclination towards the upper side and acting on the upper, first chucking point of the outer lever, the second leg of the torsion leg spring projecting from the further front end from under the axle with a short arm, said short arm merges into a bow-shaped clip that acts on a finger-like extension projecting from the inner lever on the one end and comprising the second chucking point.

3. The switchable finger lever according to claim 2, wherein the finger-like extension of the inner lever is configured as extending substantially upright from the underside in a direction of the upper side, the short arm of the coil assembly extending substantially from the underside to the upper side on outer sides of the outer lever and merging in a region of the upper side into the bow-shaped clip that extends crosswise to the lever longitudinal axis, said bow-shaped clip engaging over end pieces of the inner lever and comprising on an inner side of the finger-like extension, the second chucking point.

4. The switchable finger lever according to claim 3, wherein there are two of the coil assemblies and the two bow-shaped clips of the second legs of the two coil assemblies are united into a common crosspiece.

5. The switchable finger lever according to claim 1, wherein the coil assembly comprises two load-bearing coils.

6. The switchable finger lever according to claim 1, wherein as viewed from the further end towards the one end, the finger lever extends out into a tapering section together with the axle so that the common axle does not protrude beyond outer sides of the outer lever outside of the tapering section.

7. The switchable finger lever according to claim 1, wherein a radial collar extends inwards from an inner peripheral wall of the at least one bushing and surrounds the axle with lash, a complementary annular groove being situated opposite the radial collar, and the radial collar being seated through a segmental section in the annular groove.

* * * * *